US005215509A

United States Patent [19]

Meyer

[11] Patent Number: 5,215,509

[45] Date of Patent: Jun. 1, 1993

[54] ROPE JUMPING DEVICE

[75] Inventor: Burton C. Meyer, Downers Grove, Ill.

[73] Assignee: Meyer/Glass Design, Chicago, Ill.

[21] Appl. No.: 884,906

[22] Filed: May 18, 1992

[51] Int. Cl.[5] ..... A63B 5/22

[52] U.S. Cl. ..... 482/82; 482/81

[58] Field of Search ..... 482/82, 81; 273/26 E, 273/196, 197 R, 197 A

[56] References Cited

U.S. PATENT DOCUMENTS

| | | | |
|---|---|---|---|
| 2,911,063 | 11/1959 | Wolfson | 482/82 |
| 3,498,613 | 3/1970 | Dreyer | 273/197 R |
| 3,601,398 | 8/1971 | Brochman | 273/26 E |
| 3,612,522 | 10/1971 | Ekonen | 482/82 |
| 4,095,787 | 6/1978 | Saferstein | 273/26 E |
| 4,736,945 | 4/1988 | Vinciguerra | 482/82 |

*Primary Examiner*—Richard J. Apley
*Assistant Examiner*—Lynne A. Reichard

[57] ABSTRACT

A rope jumping device, including a rope having opposite ends, a platform and an elongated handle. The arm is rotatably mounted on the handle near one end thereof. An anchor is pivotally connected to the platform. One end of the rope is connected to the arm and the other end is connected to the anchor. The rope is of sufficient length such that a user, when standing on the platform, will be able to hold the handle above his or her head. Manipulation of the handle by rotation when the handle is elevated above the head of the user causes rotation of the arm, the rope and the anchor, with the rope describing a generally hyperbolic path above the pivotal connection of the anchor to the base. The arm is mounted on the handle for limited longitudinal movement relative to one end of the handle in addition to rotational mounting on the handle.

3 Claims, 1 Drawing Sheet

ROPE JUMPING DEVICE

BACKGROUND AND SUMMARY OF THE INVENTION

This invention is directed to a self-contained rope jumping device having a rope which can be twirled around a generally vertical axis and operated by one person.

The object of this invention is a self-contained jump rope device which can be twirled by one person while both the twirler and another person jump the revolving rope.

Another object of this invention is a self-contained vertical twirling jump rope device which is usable without being attached to a fixed structure.

Another object of this invention is a vertical jumping device which can be used by children as a playing toy or by adults as an exercising device.

Other objects of the invention may be found in the following specification, claims and drawings.

DESCRIPTION OF THE PREFERRED EMBODIMENT

This invention is concerned with a jump rope device 11 which can be used by children for play or by adults for exercise or by either for both purposes. The device consists of a plastic rope 13 which can vary in length from 4 to 6 or 7 feet depending on whether or not the jump rope device is to be used specifically by children or adults. Of course, it should also be appreciated that a single length rope in the range of 5 to 5½ feet may be used by either children or adults. Polypropylene is a suitable material for use as the rope 13.

Figure 1:
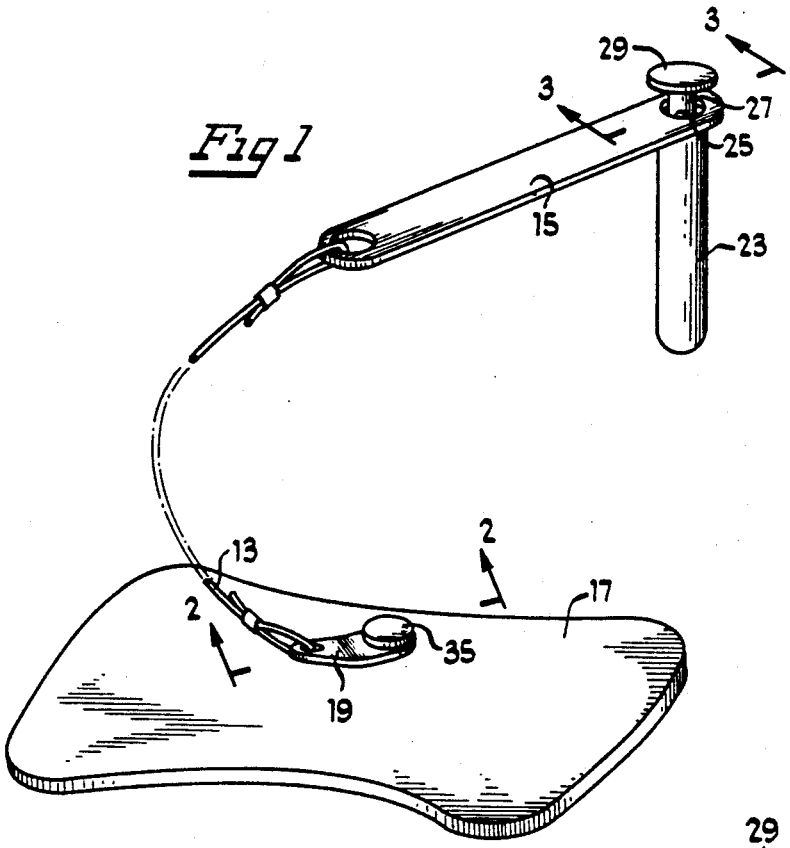
FIG. 1 is a perspective view of the jump rope device of this invention shown in its operating position with a portion of the jump rope broken away for compactness of the illustration.
Figure 3:
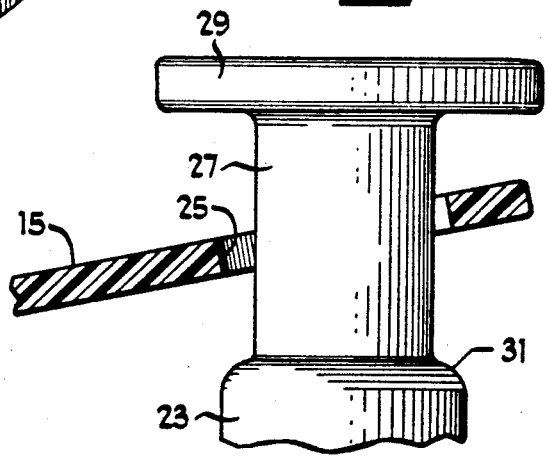
FIG. 3 is an enlarged, partial cross-sectional view taken along line 3—3 of FIG. 1.
Figure 2:
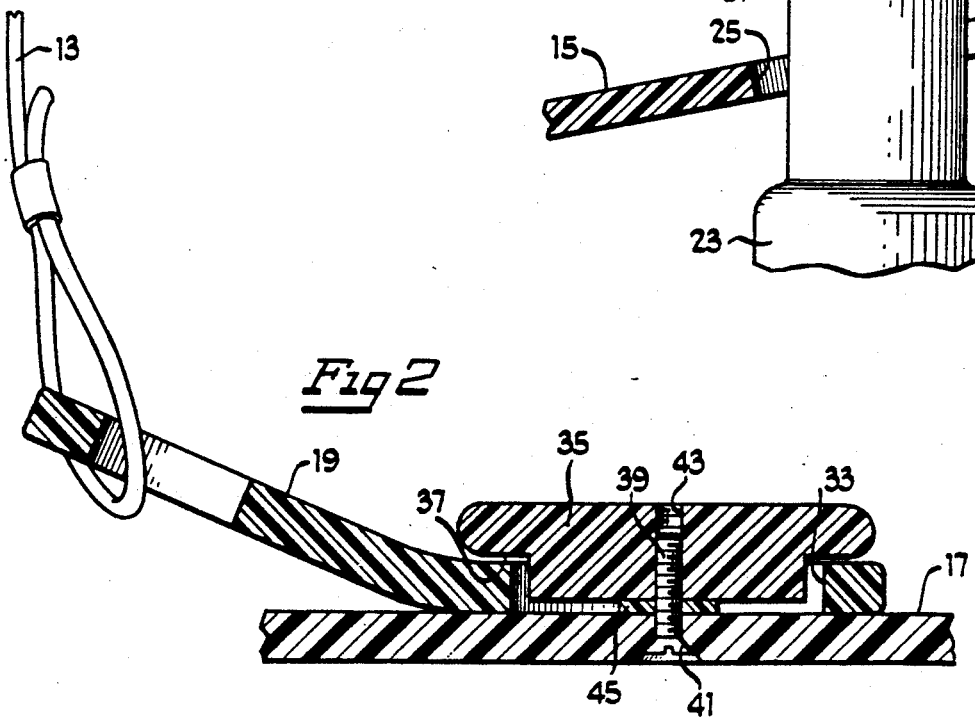
FIG. 2 is an enlarged, partial cross-sectional view taken along line 2—2 of FIG. 1.

The rope 13 is tethered at one end to a rotatable arm 15 and, at its opposite end, to a platform 17. The attachment of the rope to the platform is accomplished through an anchor 19 which is pivotally attached to the platform for rotation above a vertical axis as viewed in FIG. 1.

The anchor 19 is bent with a flattened portion in contact with the platform 17 and a bent-up portion which clears the platform when the anchor is rotated. The rotatable arm 15 is supported for rotation at one end of an elongated cylindrical handle 23. The attachment of the arm to the handle is achieved through the provision of a circular opening 25 at one end of the handle which fits over a necked portion 27 of the handle which is of reduced diameter. The reduced diameter necked portion 27 extends a short longitudinal distance along the handle from one end thereof. At the outer end of the necked portion is a cap 29 which has a diameter greater than that of the circular opening 25 so that the arm 15 will be retained on the handle. The cap 29 can be attached to the necked portion 27 in any conventional manner. A shoulder 31 is formed on the handle at the inner end of the necked portion. The shoulder 31 has a diameter greater than that of the cylindrical opening 25 in the arm 15. This method of mounting the arm 15 on the handle 23 not only allows the arm 15 to rotate relative to the handle 23, but also permits an up and down tilting action of the arm relative to the handle limited only by the engagement of the arm 15 with the shoulder 31 or the cap 29 of the handle 23.

The anchor 19 is pivotally mounted on the platform 17 through means of an opening 33 formed in the flattened portion of the anchor which rests on the platform. The opening 33 receives a knob 35 having a peripheral flange 37 which extends over the anchor. The knob 35 is held in position by a screw 39 which fits through an opening 41 in the platform and extends a threaded passage 43 in the knob. A plastic washer 45 is positioned between the knob and the platform. The arm 15, platform 17, anchor 19, handle 23, knob 35 and washer 45 may be formed of high impact styrene or polyethylene. Of course, other suitable materials may also be used.

In use, player positions the handle 23 high above his or her head and rotates the arm 15 by swinging the handle 23. Swinging of the handle causes rotation of the rope 13 in a hyperbolic shaped generated sphere about a vertical axis extending through the knob 35. During use, a player may stand on the platform 17 to hold it in position on a supporting surface. A player can jump rope with one foot on each end of the platform 17 or with both at one end thereof. Two players can jump the rope 13 as one player spins it through manipulation of the handle 23. The rather flexible mounting of the arm 15 on the necked portion 27 of the handle 23 permits a flopping up and down motion of the rope 13 as the player jumps up and down.

I claim:

1. A rope jumping device, including:

a rope having opposite ends, a platform, an elongated handle;

a arm rotatably mounted on said handle near one end thereof;

an anchor pivotally mounted to said platform, one end of said rope connected to said arm and the other end of said rope connected to said anchor, said rope being of sufficient length so that a user when standing on said platform will be able to hold said handle above his or her head, manipulation of said handle by rotation when said handle is elevated above the head of said user causing rotation of said arm, said rope and said anchor, with said rope describing a generally hyperbolic path above the pivotal connection of said anchor to said base.

2. The rope jumping device of claim 1 in which said elongated handle is headed at one end and said arm has an opening which receives said handle, but does not pass said headed end.

3. The rope jumping device cf claim 1 in which said arm is mounted on said handle for a limited longitudinal movement relative to one end of said handle.

* * * * *